US009531096B2

(12) United States Patent
Chen et al.

(10) Patent No.: US 9,531,096 B2
(45) Date of Patent: Dec. 27, 2016

(54) MULTIPLE-PIECE FPC CONNECTOR

(71) Applicant: HARUMOTO TECHNOLOGY (SHEN ZHEN) CO., LTD., Shenzh (CN)

(72) Inventors: Shih-Chieh Chen, Taipei (TW); Yi-Gen Lyu, Taipei (TW)

(73) Assignee: HARUMOTO TECHNOLOGY (SHEN ZHEN) CO., LTD., Shenzh (CN)

( * ) Notice: Subject to any disclaimer, the term of this patent is extended or adjusted under 35 U.S.C. 154(b) by 0 days.

(21) Appl. No.: 14/835,713

(22) Filed: Aug. 26, 2015

(65) Prior Publication Data

US 2016/0064844 A1 Mar. 3, 2016

(30) Foreign Application Priority Data

Aug. 28, 2014 (CN) ..... 2014 1 0432439

(51) Int. Cl.

| | |
|---|---|
| ***H01R 12/79*** | (2011.01) |
| ***H01R 12/88*** | (2011.01) |
| ***H01R 12/77*** | (2011.01) |
| *H01R 12/89* | (2011.01) |
| *H01R 43/24* | (2006.01) |

(52) U.S. Cl.

CPC ..... *H01R 12/771* (2013.01); *H01R 12/88* (2013.01); *H01R 12/79* (2013.01); *H01R 12/89* (2013.01); *H01R 43/24* (2013.01)

(58) Field of Classification Search

CPC ..... H01R 12/79; H01R 12/88; H01R 43/16; H01R 43/24; H01R 23/684; H01R 23/668

USPC ..... 439/260, 495, 885

See application file for complete search history.

(56) References Cited

U.S. PATENT DOCUMENTS

| | | | | | |
|---|---|---|---|---|---|
| 6,142,790 | A * | 11/2000 | Niitsu | H01R 12/592 | 439/495 |
| 6,146,171 | A * | 11/2000 | Kunishi | H01R 12/592 | 439/260 |
| 6,267,620 | B1 * | 7/2001 | Ma | H01R 12/79 | 439/260 |
| 6,382,994 | B1 * | 5/2002 | Chang | H01R 12/7094 | 439/157 |
| 6,431,907 | B1 * | 8/2002 | Ma | H01R 12/79 | 439/260 |
| 6,761,573 | B1 * | 7/2004 | Chiu | H01R 12/85 | 439/260 |
| 7,520,774 | B2 * | 4/2009 | Watanabe | H01R 9/037 | 439/260 |
| 7,530,831 | B2 * | 5/2009 | Nishimatsu | H01R 12/79 | 439/260 |

(Continued)

*Primary Examiner* — Gary Paumen
(74) *Attorney, Agent, or Firm* — Chun-Ming Shih

(57) ABSTRACT

A multiple-piece FPC connector disposes an insulation seat and a cover separately to constitute a multiple-piece structure, and buries entirety or part of an electric conduction terminal set into an insert molding mold of the connector insulation seat prior to the insert molding for the connector insulation seat to perform joining of the connector insulation seat and the electric conduction terminal set, such that fixation for the electric conduction terminal set is achieved without plug equipment. Thereby, complexity of making the FPC connector is reduced, and the issues of electric conduction terminal dropping and residual stress of insulation seat are solved.

4 Claims, 14 Drawing Sheets

(56) References Cited

U.S. PATENT DOCUMENTS

| | | | | |
|---|---|---|---|---|
| 7,628,642 | B2 * | 12/2009 | Chen | H01R 12/88 439/260 |
| 7,914,321 | B2 * | 3/2011 | Huang | H01R 12/778 439/260 |
| 8,025,516 | B2 * | 9/2011 | Yokoo | H01R 12/79 439/260 |
| 8,075,328 | B2 * | 12/2011 | Ashibu | H01R 12/88 439/260 |
| 8,662,915 | B2 * | 3/2014 | Ueda | H01R 12/79 439/260 |
| 2005/0026487 | A1 * | 2/2005 | Yu | H01R 12/79 439/260 |
| 2005/0118849 | A1 * | 6/2005 | Okita | H01R 12/88 439/260 |
| 2009/0318001 | A1 * | 12/2009 | Hemmi | H01R 12/88 439/260 |
| 2013/0023138 | A1 * | 1/2013 | Sasaki | H01R 12/88 439/260 |
| 2013/0171893 | A1 * | 7/2013 | Soo | H01R 9/091 439/885 |

* cited by examiner

MULTIPLE-PIECE FPC CONNECTOR

CROSS-REFERENCE TO RELATED APPLICATIONS

This application claims the priority of China Patent Application No. 201410432439.1 filed on Aug. 28, 2014, in the State Intellectual Property Office of the P.R.C., the disclosure of which is incorporated herein by reference.

BACKGROUND OF THE INVENTION

Field of the Invention

The invention relates to a FPC connector, more particularly to a multiple-piece FPC connector disposing an insulation seat and a cover separately to constitute a multiple-piece structure.

Descriptions of the Related Art

In various modern electronic equipments, multiple printed circuit boards (referred to as PCB hereinafter) are usually necessary to provide different electrical functions. Most electrical signal deliveries between each of the PCBs are currently achieved by flexible printed circuit board (referred to as FPC hereinafter) and the FPC connector built on the PCB. However, with the development trend of thinner and smaller electronic equipment, internal space of the electronic equipment is reduced significantly such that the dimensions of various FPC connectors are forced to be reduced. In practice, The height dimension of the FPC connector has been reduced from early 2.0 mm to 0.5~0.6 mm, while the pitch dimension of the electric conduction terminals of the FPC connector has been changed from 1.0 mm to 0.2~0.3 mm particularly.

In order to meet the requirement of electrical signal delivery, the FPC connectors of partial specifications are even equipped with nearly a hundred of electric conduction terminals. There is considerable technical difficulty to dispose so many electric conduction terminals in the FPC connector with respect to either design or fabrication. Refer to FIG. 1, which is a schematic view showing an action of an FPC connector plug technique widely used in the industry currently. As shown in FIG. 1, electric conduction terminals 3, 4 on both left and right sides are inserted into terminal insertion holes 21, 22 reserved on both left and right sides of a connector body 2 laterally by a plug equipment, and a clamping force is provided to the electric conduction terminals 3, 4, respectively, by forming walls of the terminal insertion holes 21, 22 to accomplish assemblage of the FPC connector. The connector body 2 is usually made by means of insert molding, so that residual stress of molding always exists inside the connector body 2.

Moreover, during insertion of the electric conduction terminals 3, 4, interference and extrusion with the connector body 2 cannot be avoided, such that generation of insertion internal stress inside the connector body 2 cannot be avoided. As such, although flatness of SMT pins of electric conduction terminals meet product design requirement after normal temperature assemblage, the residual stress inside the connector body will be released due to high temperature as the FPC connector undergoes high temperature process for SMT, such that warpage deformation on two sides or other portions of the connector body is induced to destroy the flatness of the SMT pins, so that missing solder phenomenon might occur.

Furthermore, conventional FPC connectors are limited to dimension and terminal quantity usually, such that the thickness of the walls of the above terminal insertion holes for the connector body is constrained considerably. As such, not only the difficulty of making and molding the connector body will increase, but also the connector body might be incapable of providing sufficient clamping force for the electric conduction terminals, so that electric conduction terminals may be detached from the connector body easily, such that the FPC connector loses the original electrical signal delivery function.

According to structural form, current FPC connectors may be divided into three categories roughly, including forward overturning based, rearward overturning based and drawer based FPC connectors, among which, the rearward overturning based FPC connector is the most common one. In the rearward overturning based FPC connector, a rotatable actuation body (known as SLIDER) is disposed on a rear end of the connector body. As the actuation body rotates to an actuation state, the elastic arms of the electric conduction terminals are forced to deform, such that electrical connection with FPC is achieved. Generally, plastic material will be selected for the actuation body in order to avoid electrical short circuit between electric conduction terminals. However, as the actuation body made of plastic material is in rotation, abrasion due to contact with the electric conduction terminals cannot be avoided, and the abrasion for the actuation body will get severer as the number of rotations increases, such that the capability of the actuation body forcing the elastic arms of the electric conduction terminals to deform is reduced significantly, so that the joint pressure of the electric conduction terminals that can be provided to the FPC keeps decreasing. Thus, only 10 to 20 times of normal uses are guaranteed for the rearward overturning based FPC connector in the industry now. In addition, due to poor ductility of plastic material, the actuation body made of plastic material is prone to fracture and detachment destroying under force. Such situation is criticized in industries, but there is no thorough solution in the industries.

From above description, those skilled in the art are seeking for providing a FPC connector to solve various problems for above conventional FPC connectors effectively.

SUMMARY OF THE INVENTION

In view of the shortages of the above prior arts, the invention provides a multiple-piece FPC connector for electrically connecting a flexible printed circuit board, disposing an insulation seat and a cover separately to constitute a multiple-piece structure, and burying entirety or part of an electric conduction terminal set during insert molding of the insulation seat to perform joining of the electric conduction terminal set and the insulation seat.

To achieve above object and other objects, the invention serves to provide a multiple-piece FPC connector for electrically connecting a flexible printed circuit board, includes an electric conduction terminal set, a reinforcement terminal set, a connector insulation seat and an upper cover. The electric conduction terminal set has multiple first electric conduction terminals and second electric conduction terminals in an interlacing arrangement for crimping electrical joints of the flexible printed circuit board, respectively. The first, second electric conduction terminals has a predetermined electric conduction terminal pitch. The first electric conduction terminals are constituted by a first upper clamp arm, a first lower clamp arm and a first linkage, respectively. The first linkage is connected with the first upper clamp arm and the first lower clamp arm. The second electric conduction terminals are constituted by a second upper clamp arm, a second lower clamp arm and a second linkage, respectively. The second linkage is connected with the second upper clamp arm and the second lower clamp arm. The reinforcement terminal set has at least two reinforcement terminals provided on left and right sides of the electric conduction terminal set. The connector insulation seat is made by insert molding, burying the entirety or part of the first, second lower clamp arms into an insert molding mold of the connector insulation seat prior to insert molding of the connector insulation seat, such that the connector insulation seat is joined with the entirety or part of the first, second lower clamp arms integrally to fix the electric conduction terminal set by the connector insulation seat. The upper cover can join with the connector insulation seat to constitute a framework structure. The framework structure has an insertion opening and an insertion space in a front end, and the flexible printed circuit board can enter the insertion space to get close to the electric conduction terminal set via the insertion opening. The first, second electric conduction terminals of the electric conduction terminal set can be forced for actuation to achieve electrical contact with the flexible printed circuit board, respectively. The connector insulation seat and the upper cover are separately to constitute a multiple-piece structure.

Preferably, the invention further includes a first electric conduction terminal material belt having a first electric conduction terminal connection portion and a second electric conduction terminal material belt having a second electric conduction terminal connection portion, and the first electric conduction terminal connection portion is intersected with the body of the first electric conduction terminals perpendicularly, and the second electric conduction terminal connection portion is intersected with the body of the second electric conduction terminals perpendicularly. The invention further includes a reinforcement terminal material belt having a reinforcement terminal connection portion, and the reinforcement terminal connection portion is intersected with the reinforcement terminals perpendicularly. The first, second electric conduction terminal connection portions are connected SMT pins of the first, second lower clamp arms.

Preferably, the first electric conduction terminals is constituted by a first upper clamp arm, a first lower clamp arm and a first linkage for crimping electrical joints of the flexible printed circuit board, the first linkage connecting the first upper clamp arm and the first lower clamp arm, and the second electric conduction terminals is constituted by a second upper clamp arm, a second lower clamp arm and a second linkage for crimping electrical joints of the flexible printed circuit board, the second linkage connecting the second upper clamp arm and the second lower clamp arm. Either the first, second lower clamp arms are formed with a clamp arm folding structure nearby SMT pins of the first, second lower clamp arms, respectively, or the first, second linkages are formed with a linkage folding structure, respectively, such that the first, second upper clamp arms are allowed to turn over away from the first, second lower clamp arms, respectively, to form terminal structures for crimping electrical joints of the flexible printed circuit board in conjunction with the first, second lower clamp arm, respectively.

Preferably, the upper cover is made from plastic or composite material composed of metal and plastic. The upper cover has a long side having at least one reinforcement structure embossed outwards or recessed inwards.

In first embodiment of the invention, the upper cover and the connector insulation seat are assembled integrally to constitute a rearward overturning based FPC connector, and further includes an actuation body provided on a rear end of the framework structure in a rotatable manner. The actuation body has a pushing terminal set and an actuation insulation seat. The pushing terminal set has multiple pushing terminals, which are arranged in one row and all has a pushing portion. A pitch of the pushing terminals is essentially the same as that of the first, second electric conduction terminals. The actuation insulation seat is joined with the pushing terminals, and the actuation body can be forced to rotate relatively to the framework structure for the pushing portions of the pushing terminals to push the first, second upper clamp arms corresponding to the locations thereof, respectively, to force the first, second upper clamp arms to be in electrical contact with electrical joints of the flexible printed circuit board entering the insertion space by means of rotation using a rotation portion of the first, second linkages connected thereto as a fulcrum, respectively.

Preferably, further includes a rotation engagement structure provided on a rear end of the framework structure for the actuation body. The rotation engagement structure is disposed on the reinforcement terminal set and/or the connector insulation. The pushing portions of the pushing terminals are solid structure or hollow structure, and the pushing terminals are made from metal or ceramic.

In second embodiment of the invention, further includes a slide rail structure disposed on the reinforcement terminal set and/or the connector insulation seat. The upper cover can be slide relative to the connector insulation seat by the slide rail structure to constitute a drawer based FPC connector. The upper cover is slide in a direction toward to or away from the insertion opening of the framework structure in order to either achieve or release electrical contact of the flexible printed circuit board and the electric conduction terminal set.

In third embodiment of the invention, further includes a hinged structure disposed on the reinforcement terminal set and/or the connector insulation seat. The upper cover can be rotated relative to the connector insulation seat by the hinged structure to constitute a forward overturning based FPC connector, and to either achieve or release electrical contact of the flexible printed circuit board and the electric conduction terminal set.

In fourth embodiment of the invention, the first, second electric conduction terminals may be forced to deform elastically in the same direction to compensate height difference between there. The upper cover may be forced to be lifted for the insertion space to be exposed, such that the flexible printed circuit board may enter the insertion space to get close to the electric conduction terminal set. The upper cover may also be forced for actuation to achieve electrical contact of the electric conduction terminal set and the flexible printed circuit board.

Preferably, further includes a cover insulating piece disposed on the bottom of the upper cover, and the cover insulating piece has an insulation pushing portion to force the first, second upper clamp arms to be in electrical contact with electrical joints of the flexible printed circuit board entering the insertion space by means of rotation using a rotation portion of the first, second linkages connected thereto as a fulcrum, respectively.

Compared to the prior arts, the invention disposes an insulation seat and a cover separately to constitute a multiple-piece FPC connector, the entirety or part of the electric conduction terminal set of the invention is buried into an insert molding mold of a connector insulation seat in advance in order to join the connector insulation seat and the electric conduction terminal set integrally during the insert molding for the connector insulation seat, such that fixation for the electric conduction terminal set is achieved without plug equipment. Thereby, complexity of making the FPC connector is reduced, and the issues of electric conduction terminal dropping and residual stress of insulation seat are solved. After that, a drawer based, forward overturning based FPC connector may be constituted in conjunction with an upper cover. A rearward overturning based FPC connector may be constituted in simultaneous conjunction with an upper cover and an actuation body.

DETAILED DESCRIPTION OF THE PREFERRED EMBODIMENT

Figure 1:
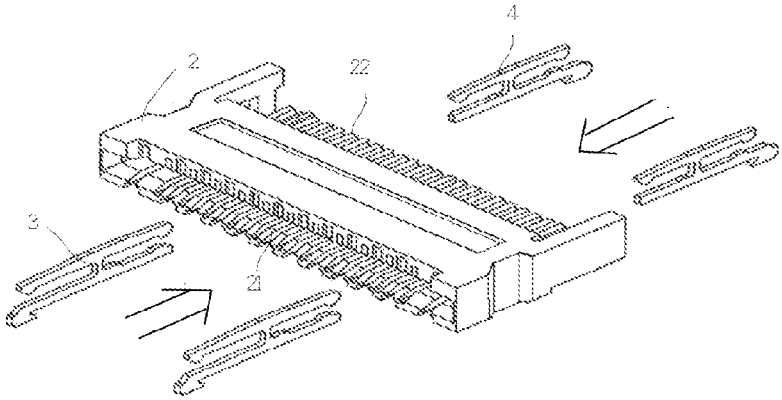
Figure 1 (prior art)
FIG. 1 is a schematic view showing a plug action for a conventional FPC connector.
Figure 2:
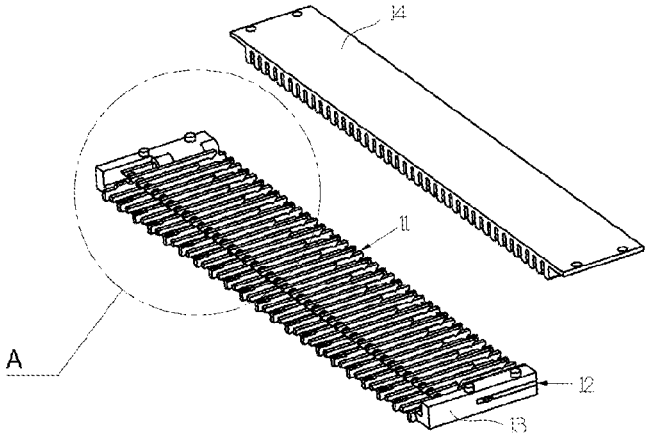
FIG. 2 is an exploded view for members of a multiple-piece FPC connector of the invention.
Figure 3:
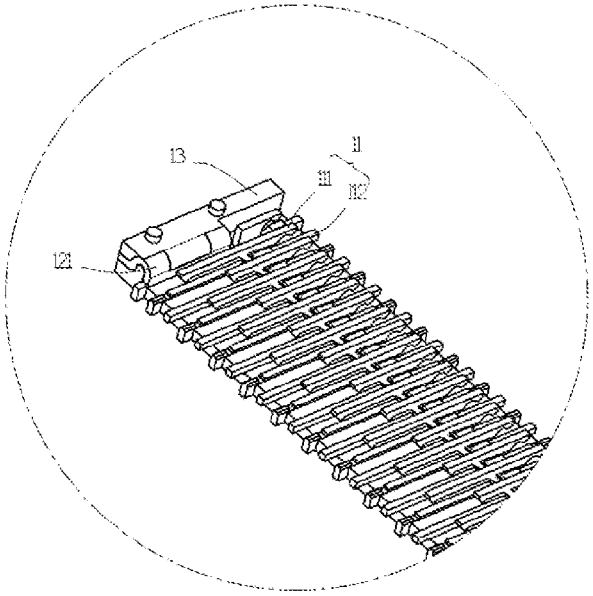
FIG. 3 is a partial enlarged view showing a region indicated by symbol A for the multiple-piece FPC connector shown in FIG. 2.

Embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions of elements may be exaggerated for clarity, and the same reference numerals will be used throughout to designate the same or like components.

In order to solve various issues of conventional FPC connectors effectively, the invention intends to improve structure of FPC connector, and provides a multiple-piece FPC connector, which insulation seat and cover are disposed separately to constitute a multiple-piece structure, and joining of electric conduction terminals and the insulation seat is accomplished by changing original lateral insertion approach to a burying insert molding approach. Thereby, the difficulty for making the FPC connector is reduced, and the issues for dropping of the electric conduction terminals and residual stress of the insulation seat are solved simultaneously.

Figure 9:
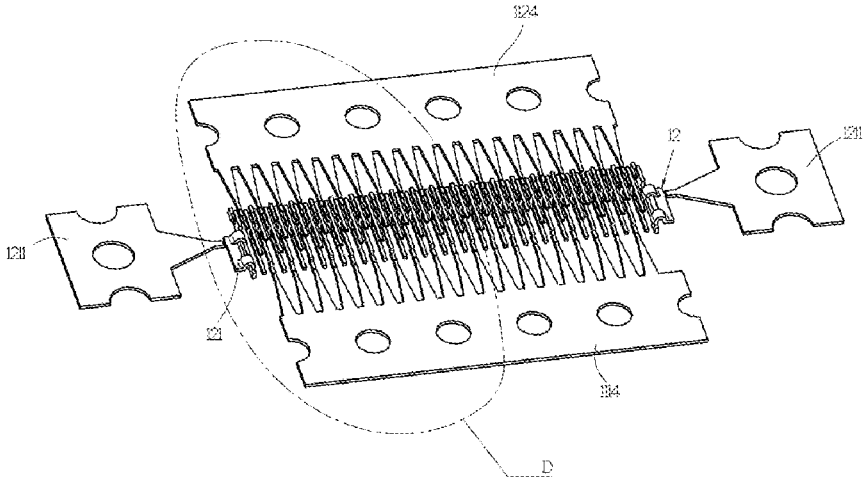
FIG. 9 is a schematic view showing a second structural mode for an electric conduction terminal set and a reinforcement terminal set of the multiple-piece FPC connector of the invention. Both of the electric conduction terminal set and the reinforcement terminal set in FIG. 9 contain a material belt.
Figure 10:
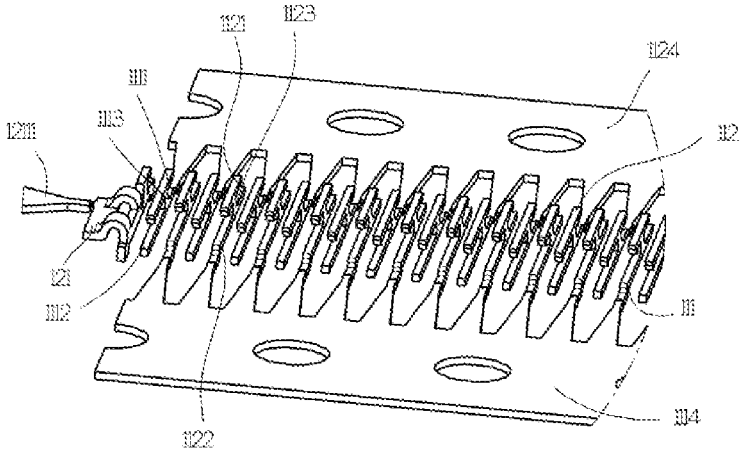
FIG. 10 is a partial enlarged view showing the region indicated by symbol D in FIG. 9.
Figure 11:
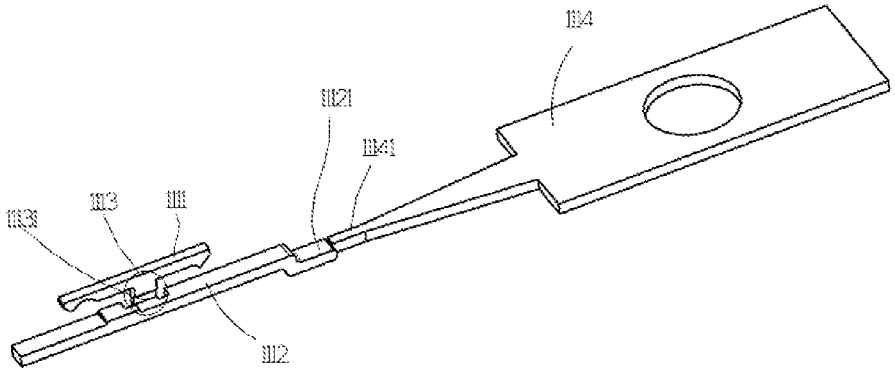
FIG. 11 shows a linkage folding structure of the first linkage of the second structural mode of the first electric conduction terminal of the multiple-piece FPC connector of the invention.

The multiple-piece FPC connector of the invention is used for electrical connection with a flexible printed circuit board (FPC in abbreviation). An insulation seat and a cover are disposed separately to constitute a multiple-piece structure. Moreover, joining of multiple terminals and the insulation seat integrally during insert molding of the insulation seat is possible. Refer to FIGS. 2 to 14 together. As shown in the figures, The FPC connector of the invention includes an electric conduction terminal set 11, a reinforcement terminal set 12, a connector insulation seat 13 and an upper cover 14. The electric conduction terminal set 11 has multiple first electric conduction terminals 111 and second electric conduction terminals 112 which are in an interlacing arrangement and have at least one electrical joint. The first, second electric conduction terminals 111, 112 may be made by using metal plates in a stamping manner, followed by forming a protective layer over terminal surfaces by using electroplating, such that protection is provided to extend service life of electric conduction terminals. Long sides of the first, second electric conduction terminals 111, 112 have cross sections like "H" shape (as shown in FIGS. 10, 11), or cross sections like "h" shape (as shown in FIGS. 8*b*, 8*c*). The electrical joints of the first, second electric conduction terminals 111, 112 are disposed on the front end of the connector insulation seat 13 for electrical connection with the flexible printed circuit board. Moreover, a staggered array design with front-rear arrangement may be used for the electrical joints of the first, second electric conduction terminals 111, 112 to correspond staggered array arrangement for electrical joints of the flexible printed circuit board.

Figure 8A:
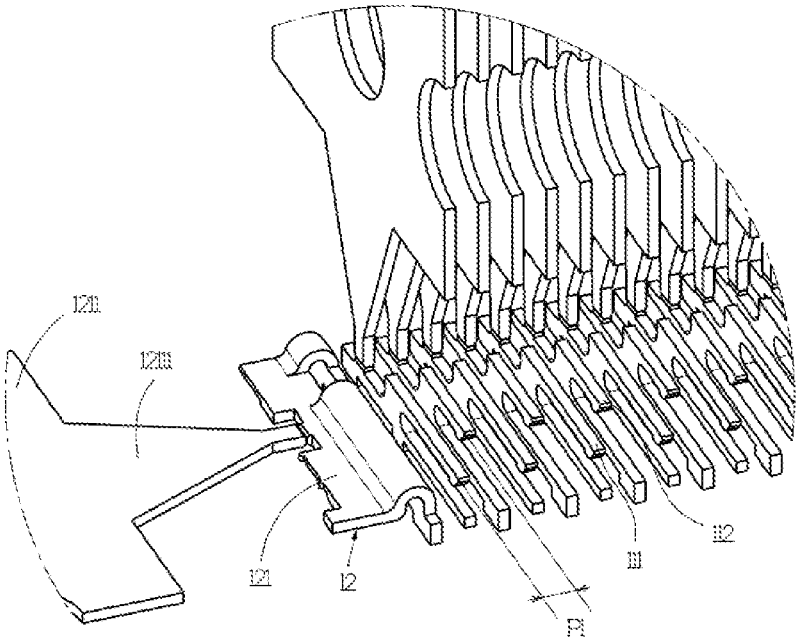
FIG. 8*a* is a partial enlarged view showing the region indicated by symbol C in FIG. 7.
Figure 8B:
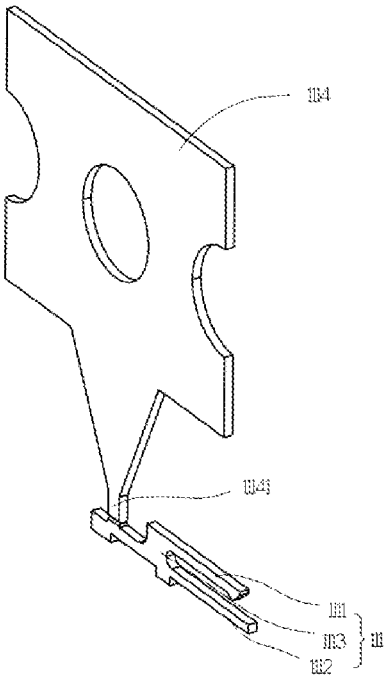
FIG. 8*b* is an enlarged view showing a single first electric conduction terminal containing the material belt in FIG. 8*a*.
Figure 8C:
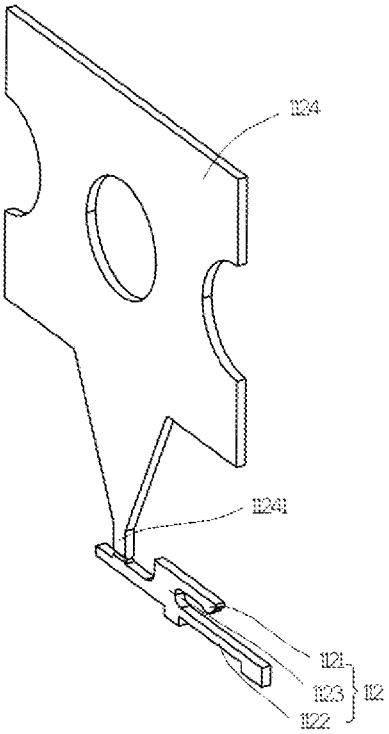
FIG. 8*c* is an enlarged view showing a single second electric conduction terminal containing the material belt in FIG. 8*a*.

As shown in FIGS. 8*a* to 8*c*, the first electric conduction terminals 111 and the second electric conduction terminals 112 have terminal cross sections like "h" shape, and two adjacent first, second electric conduction terminals 111, 112 are separated with a predetermined electric conduction terminal pitch P1. As shown in FIG. 8*b*, the first electric conduction terminal 111 is constituted by a first upper clamp arm 1111, a first lower clamp arm 1112 and a first linkage 1113 to form a terminal structure for crimping the flexible printed circuit board. The first linkage 1113 is connected with the first upper clamp arm 1111 and the first lower clamp arm 1112, respectively, and the first upper clamp arm 1111 may rotate relative to the first lower clamp arm 1112 by means of elastic deformation of the first linkage 1113, such that electrical connection with the flexible printed circuit board is accomplished or released. As shown in FIG. 8*c*, the second electric conduction terminal 112 is constituted by a second upper clamp arm 1121, a second lower clamp arm 1122 and a second linkage 1123 to form a terminal structure for crimping the flexible printed circuit board. The second linkage 1123 is connected with the second upper clamp arm 1121 and the second lower clamp arm 1122, respectively, and the second upper clamp arm 1121 may rotate relative to the second lower clamp arm 1122 by means of elastic deformation of the second linkage 1123, such that electrical connection with the flexible printed circuit board is accomplished or released. The first, second upper clamp arms 1111, 1121 and/or the first, second lower clamp arms 1112, 1122 may be provided convexly with at least one electrical joint to provide electrical contact with the flexible printed circuit board.

The reinforcement terminal set 12 has at least two reinforcement terminals 121. The two reinforcement terminals 121 are provided on left and right sides of the electric conduction terminal set 11, respectively, to reinforce structural strength of the FPC connector. In the invention, the reinforcement terminals may be made of metal material. In the terminal structure of the reinforcement terminals 121, SMT pins or THROUGH HOLE may also be formed for securing the FPC connector and a substrate to ensure securing of the FPC connector and the substrate. In addition, the reinforcement terminals 121 may also have a fastening reinforcement structure disposed in conjunction with the upper cover 14, such that the upper cover 14 fastens the connector insulation seat 13 stability.

Figure 5:
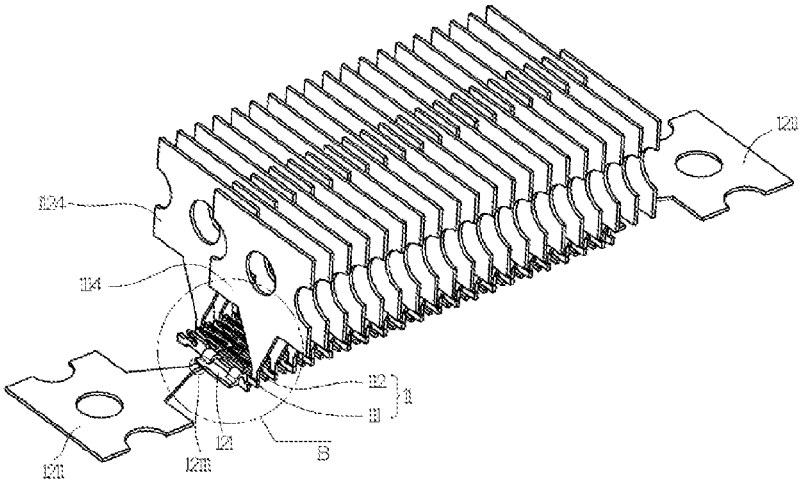
FIG. 5 is a schematic view showing a first structural mode for an electric conduction terminal set and a reinforcement terminal set of the multiple-piece FPC connector of the invention. The long side of the electric conduction terminal set shown in this figure has a cross section like "H" shape, and comprises a material belt connecting with the electric conduction terminal set.
Figure 6:
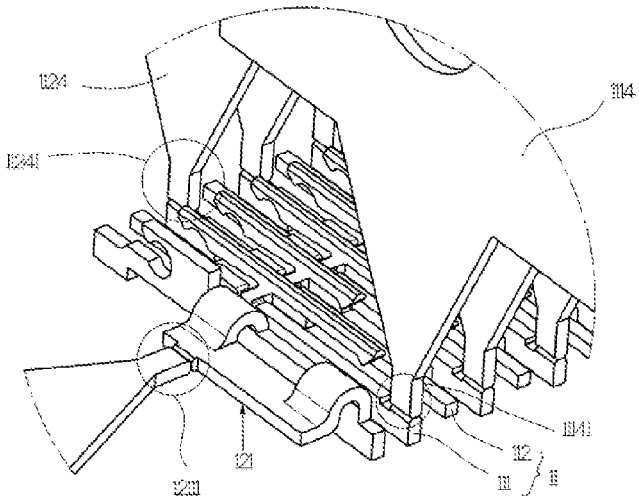
FIG. 6 is a partial enlarged view showing the region indicated by symbol B in FIG. 5.
Figure 7:
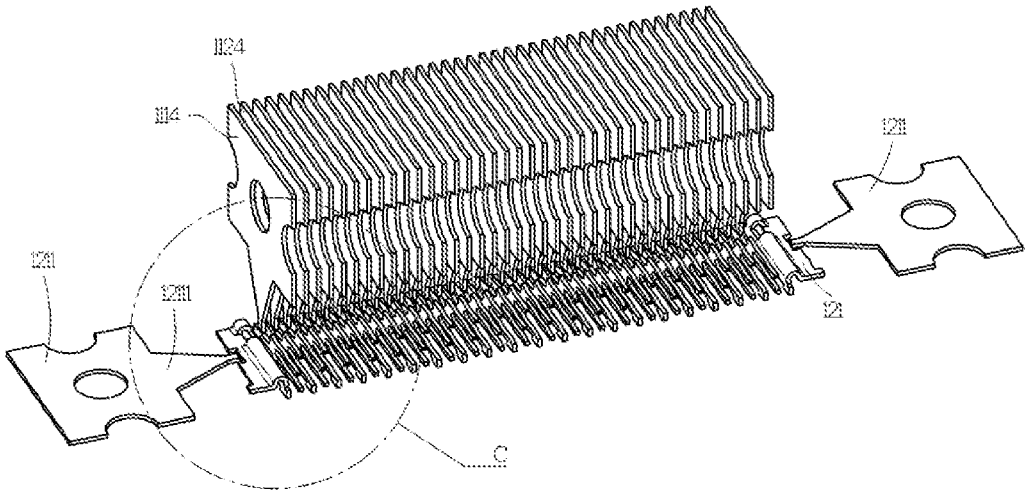
FIG. 7 is a schematic view showing a first structural mode for an electric conduction terminal set and a reinforcement terminal set of the multiple-piece FPC connector of the invention. The long side of the electric conduction terminal set shown in this figure has a cross section like "h" shape, and comprises a material belt connecting with the electric conduction terminal set.

Moreover, in addition to an insertion approach for disposing the reinforcement terminal set, a burying insert molding approach may also be used for disposing the reinforcement terminal set, that is, the entirety or part of the reinforcement terminal set is buried into an insert molding mold of the connector insulation seat for the connector insulation seat and the reinforcement terminal set to be joined integrally to fix the reinforcement terminal set by the connector insulation seat. Otherwise, as shown in FIG. 5, a terminal body of the reinforcement terminal 121 and a reinforcement terminal connection portion 12111 of a reinforcement terminal material belt 1211 intersect perpendicularly.

The connector insulation seat 13 is molded in an insert molding manner. Prior to insert molding, the entirety or part of the first, second lower clamp arms 1112, 1122 of the electric conduction terminal set 11 may be buried into an insert molding mold of the connector insulation seat 13, such that the connector insulation seat 13 and the first, second lower clamp arms 1112, 1122 are joined integrally to fix the electric conduction terminal set 11 by the connector insulation seat 13, and SMT pins of the first, second lower clamp arms 1112, 1122 is exposed out of the connector insulation seat 13. Preferably, the first, second lower clamp arms 1112, 1122 are also provided with an engaging mechanism capable of extending inward to the connector insulation seat 13 in order to engage the connector insulation seat 13. By the insert molding manner, the connector insulation seat 13 is allowed to join with the first, second lower clamp arms 1112, 1122 directly without expensive plug equipment while generation of residual stress inside the connector insulation seat 13 may be reduced effectively, such that sufficient clamping force can be provided for the electric conduction terminals to avoid detachment of the electric conduction terminals from the connector insulation seat.

In order to bury the first, second lower clamp arms 1112, 1122 into the insert molding mold of the connector insulation seat 13 for joining with the connector insulation seat 13 during insert molding of the connector insulation seat 13, the electric conduction terminal set 11 is disposed with a material belt convenient for dragging through force.

The electric conduction terminal of the invention may utilize at least the following structural modes:

First structural mode: Refer to FIGS. 5 to 8*c*. An outer surface of a clamp arm of the first electric conduction terminal 111 is intersected with a first electric conduction terminal connection portion 11141 of a first electric conduction terminal material belt 1114 perpendicularly, and an outer surface of a clamp arm of the second electric conduction terminal 112 is intersected with a second electric conduction terminal connection portion 11241 of a second electric conduction terminal material belt 1124 perpendicularly.

Second structural mode: Refer to FIGS. 9 to 11. The first, second linkages 1113, 1123 have a linkage folding structure (the linkage folding structure of the first linkage 1113 is indicated by symbol 11131 in FIG. 11), such that the first, second upper clamp arms 1111, 1121 may be turned over in a direction away from the first, second lower clamp arms 1112, 1122, respectively, to form terminal structures for crimping the flexible printed circuit board, respectively. In this structural mode, SMT pins are provided on one end side of the first, second lower clamp arms (a SMT pin of the first lower clamp arm 1112 is indicated by symbol 11121 in FIG. 11), and are extend out of the electric conduction terminal connection portions, respectively, for connection with the first, second electric conduction terminal material belts, respectively.

Figure 12:
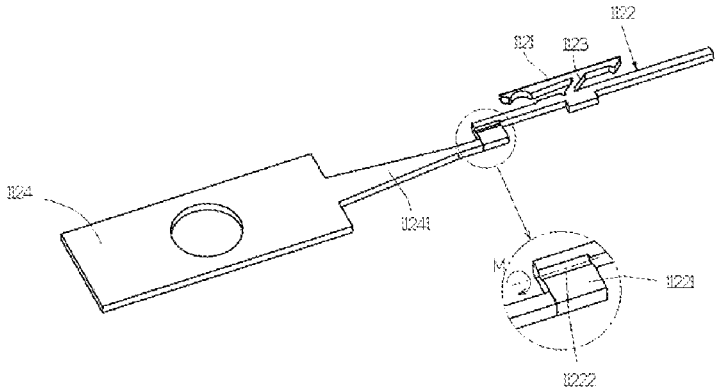
FIG. 12 shows a clamp arm folding structure of the second lower clamp arm of a third structural mode of the second electric conduction terminal of the multiple-piece FPC connector of the invention.
Figure 13:
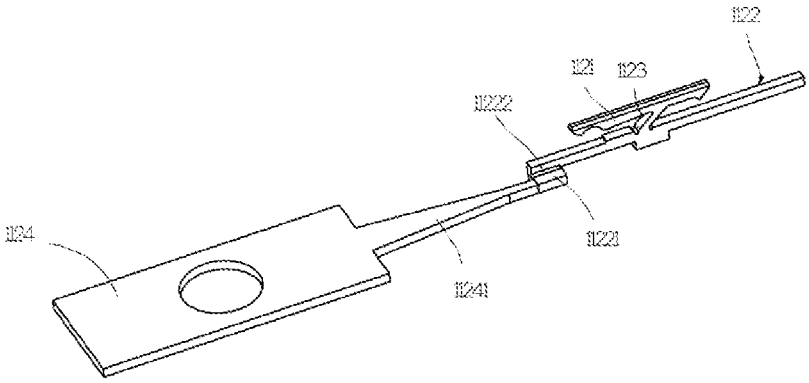
FIG. 13 is a view showing a state of the clamp arm folding structure of the second electric conduction terminal in FIG. 12 after folding.
Figure 14:
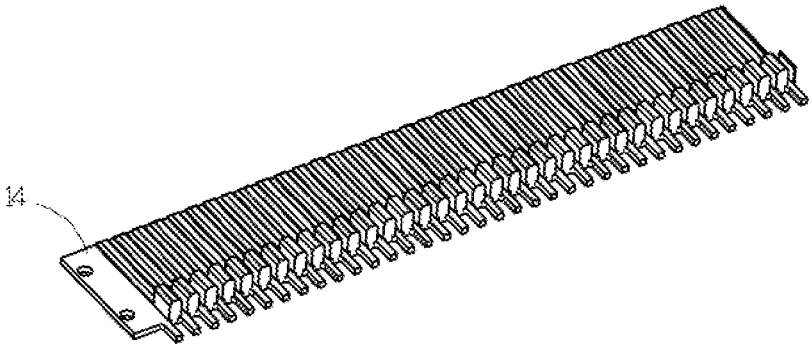
FIG. 14 is a dorsal view showing an upper cover of a first example for the multiple-piece FPC connector of the invention.

Third structural mode: Refer to FIGS. 12 to 13. Clamp arm folding structures are formed close to SMT pins of the first, second lower clamp arms, respectively, such that the first, second upper clamp arms may be turned over in a direction away from the first, second lower clamp arms after accepting folding force, respectively, to form terminal structures for crimping the flexible printed circuit board, respectively. As shown in FIG. 12, the second lower clamp arm 1122 is formed with a clamp arm folding structure 11222 nearby a SMT pin 11221 of the second lower clamp arm 1122. When a force is applied in a direction indicated by symbol M in FIG. 12, the second upper clamp arm 1121 is allowed to turn over away from the second lower clamp arm 1122, while forming a terminal structure for inserting the flexible printed circuit board as shown in FIG. 13 in conjunction with the second lower clamp arm 1122.

In summary of above description, for the several structural modes of the invention for electric conduction terminals, the clamp arms having electrical joints of the first, second electric conduction terminals are turned over in a folding manner such that terminal structures are formed, respectively, for crimping the flexible printed circuit board, and burying into an insert molding mold of the connector insulation seat by means of material belt, so that the connector insulation seat and the electric conduction terminal set are joined integrally during insert molding of the connector insulation seat. Thereby, a semi-finished product is resulted for the multiple-piece FPC connector of the invention. After that, simply in conjunction with necessary members, assemblage is possible to constitute various types of multiple-piece FPC connector products of the invention. For example, after the upper cover is assembled to the semi-finished product, a drawer based, forward overturning based multiple-piece FPC connector may be constituted. In addition to assembling the upper cover and the actuation body (also known as SLIDER) to the semi-finished product, a rearward overturning based multiple-piece FPC connector may be constituted.

Figure 4:
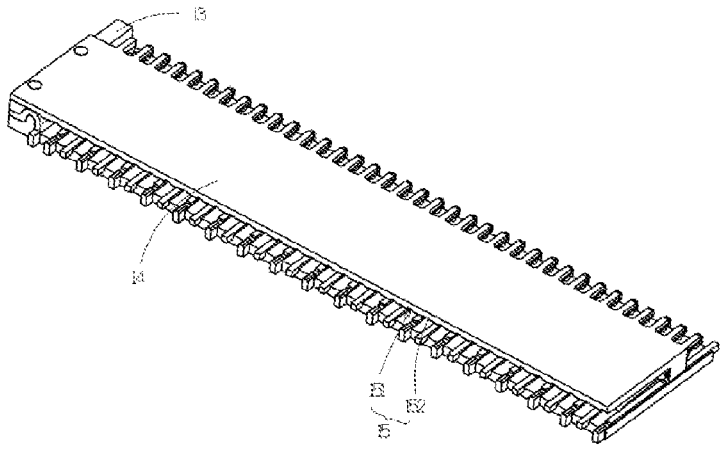
FIG. 4 is an assemblage diagram for members of the multiple-piece FPC connector of the invention.

Plastic material, or composite material composed of metal and plastic may be selected as material for the upper cover. When the material for the upper cover contain metal, the necessary thickness for the upper cover may be reduced significantly due to rigidity strength of metal, so that the entire height of the multiple-piece FPC connector can be reduced. According to capability, the upper cover may be divided into the upper cover with limiting capability and the upper cover with actuation capability. The upper cover shown in FIG. 4 is an upper cover with limiting capability. As shown in FIG. 4, the upper cover 14 and the connector insulation seat 13 may be joined to constitute one framework structure as an entirety, and may provide limiting for the flexible printed circuit board entering an insertion space 152. The front end of the framework structure has an insertion opening 151, wherein the flexible printed circuit board may enter a designated location of the insertion space 152 via the insertion opening 151. After that, electrical joints of the flexible printed circuit board may be in electrical contact with the first electric conduction terminals and the second electric conduction terminals of the electric conduction terminal set, respectively, simply via actuation of an actuation body.

Figure 23:
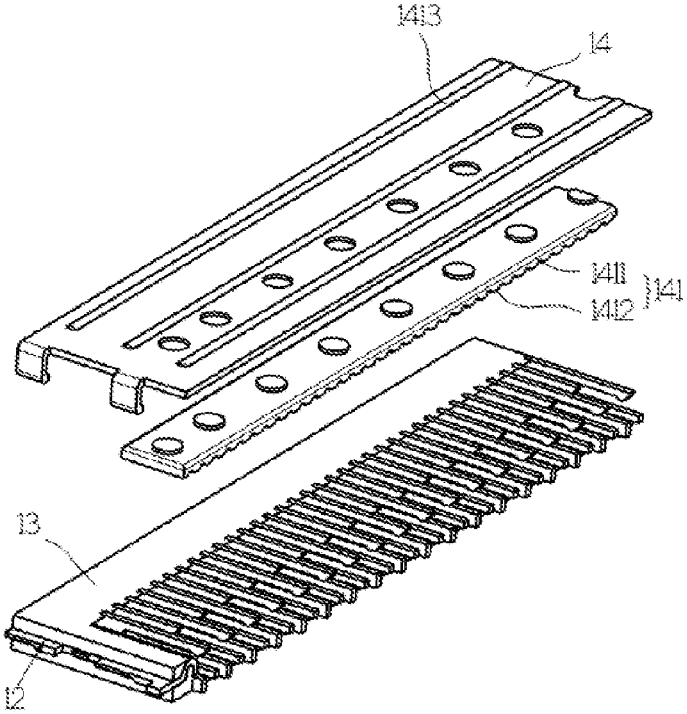
FIG. 23 is an exploded view showing members in the second example for the multiple-piece FPC connector of the invention.
Figure 24:
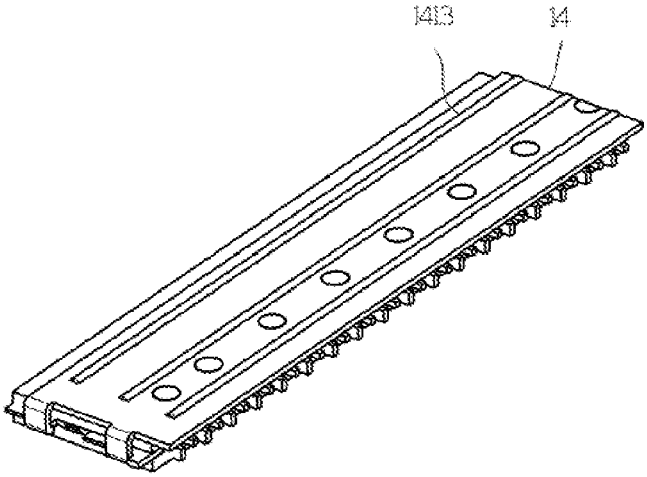
FIG. 24 is an assemblage diagram showing members in the second example for the multiple-piece FPC connector of the invention.
Figure 29:
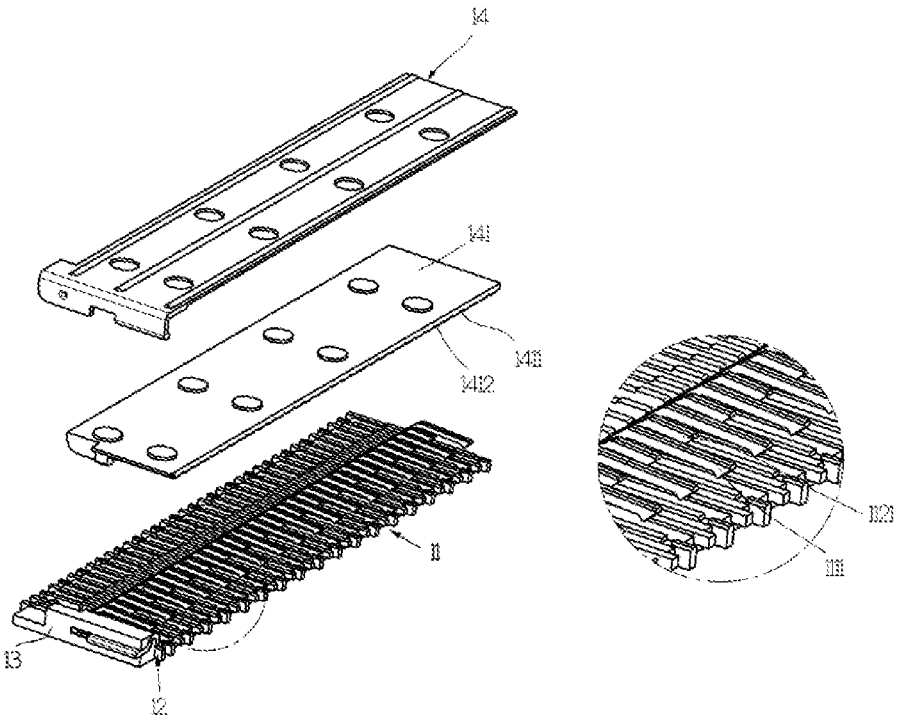
FIG. 29 is an exploded view showing members in a third example for the multiple-piece FPC connector of the invention.

The upper cover shown in FIGS. 23 and 29 is an upper cover with actuation capability. As shown in FIGS. 23 and 29, the bottom of the upper cover 14 is disposed with a cover insulating piece 141. The cover insulating piece 141 may be made of plastic material, and may be joined with the upper cover 14 integrally by means of insert molding or ultrasonic welding. The cover insulating piece 141 has an insulation pushing portion 1411 to force the first, second upper clamp arms 1111, 1121 to rotate and press downwards synchronously by using a rotation portion of the linkage connected therewith, respectively to be in electrical contact with the electrical joints of the flexible printed circuit board entering the insertion space. The cover insulating piece 141 also has multiple insulation baffles 1412, which are extended to a position between the first, second electric conduction terminals downward, respectively, for not only separating the electric conduction terminals of the electric conduction terminal set, but also preventing the upper cover from warpage deformation due to excessive length by limiting provided by the electric conduction terminals for the insulation baffles. In addition, as shown in FIG. 23, the long side of the body of the upper cover 14 has at least one reinforcement structure 1413 embossed outwards or recessed inwards to prevent the upper cover 14 from warpage deformation.

Figure 15:
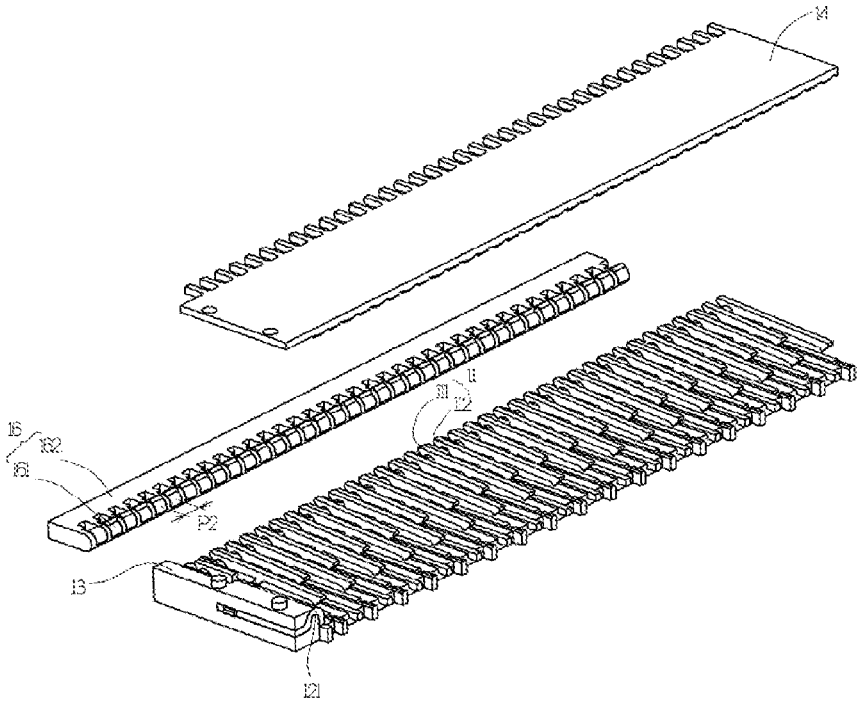
FIG. 15 is an exploded view showing members in the first example for the multiple-piece FPC connector of the invention.
Figure 16:
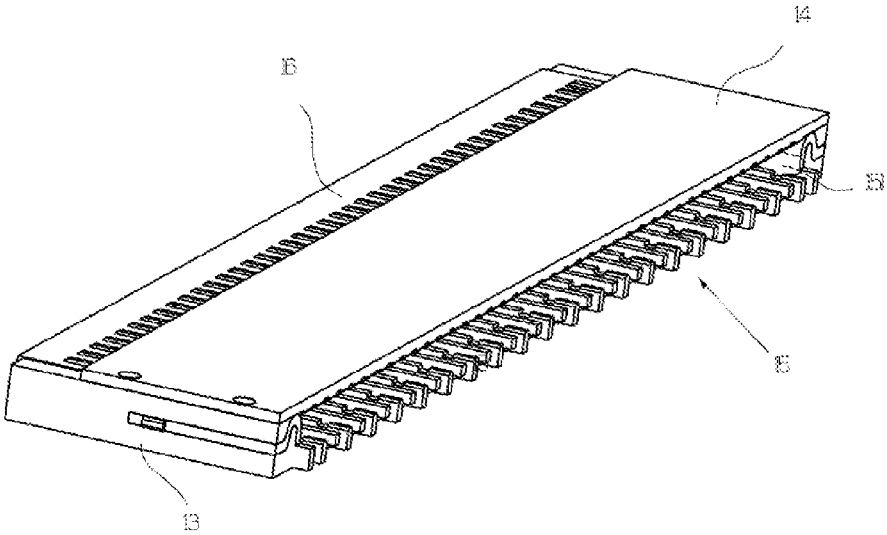
FIG. 16 is an assemblage diagram showing members in the first example for the multiple-piece FPC connector of the invention.
Figure 17:
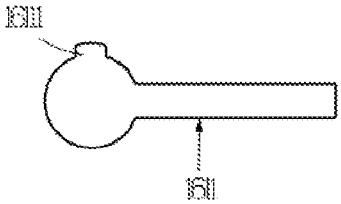
FIG. 17 is a schematic view showing the first structural mode of a metal pushing terminal in the first example for the multiple-piece FPC connector of the invention.
Figure 18:
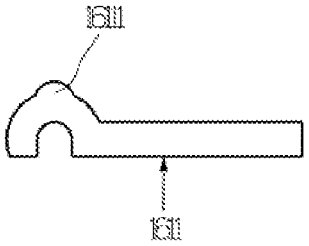
FIG. 18 is a schematic view showing the second structural mode of a metal pushing terminal in the first example for the multiple-piece FPC connector of the invention.
Figure 19:
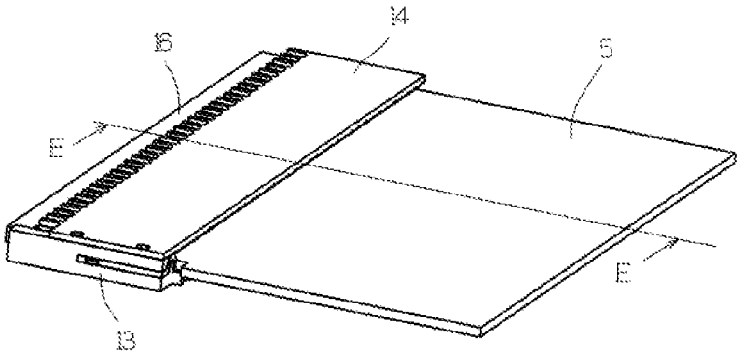
FIG. 19 is a schematic view showing a first usage state of the first example for the multiple-piece FPC connector of the invention, wherein the multiple-piece FPC connector shown in FIG. 19 is in a usage state of electrical connection with a flexible printed circuit board.
Figure 20:
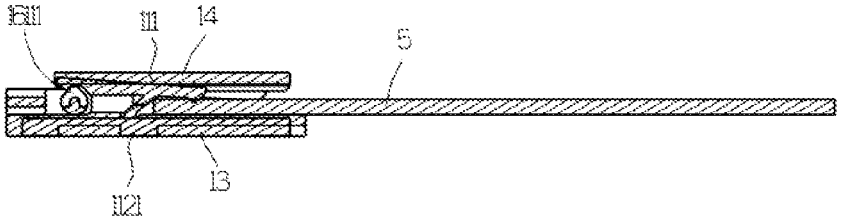
FIG. 20 is a view cut along line EE of FIG. 19.

The first example of the invention is a rearward overturning based FPC connector. Refer to FIGS. 15 to 22 together. After the upper cover 14 and the connector insulation seat 13 of FIG. 15 are assembled integrally, the framework structure 15 shown in FIG. 16 may be constituted. The rear end of the framework structure 15 is disposed with a rotatable actuation body 16, such that the rearward overturning based FPC connector as shown in FIG. 16 is formed. As shown in FIG. 15, the actuation body 16 has a pushing terminal set 161 and an actuation insulation seat 162. The pushing terminal set 161 has a plurality of pushing terminals 1611, each of which has a pushing portion 16111, arranged in one row. The actuation insulation seat 162 may be selected from plastic material, and joins those pushing terminals 1611 by means of insert molding. It should be noted that the pitch (indicated by P2 in FIG. 15) of those pushing terminals 1611 is essentially the same as the pitch (indicated by P1 in FIG. 3) of those electric conduction terminals 111, 112. Accordingly, the actuation body 16 may be forced to rotate relative to the framework structure 15 until the pushing portions 16111 of those pushing terminals 1611 push against the first, second upper clamp arms 1111, 1121 corresponding to the locations thereof, respectively, such that those first, second upper clamp arms 1111, 1121 are forced to rotate using a rotation portion of the linkage connected therewith as fulcrum, respectively, to achieve electrical contact with the electrical joints of the flexible printed circuit board 5 entering the insertion space 152, as shown in FIGS. 19 and 20.

Figure 21:
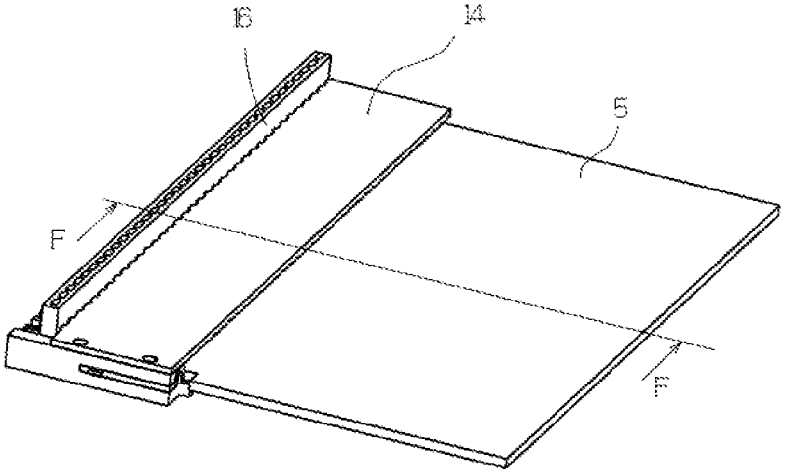
FIG. 21 is a schematic view showing a second usage state of the first example for the multiple-piece FPC connector of the invention, wherein the multiple-piece FPC connector shown in FIG. 21 is not in a usage state of electrical connection with a flexible printed circuit board.
Figure 22:
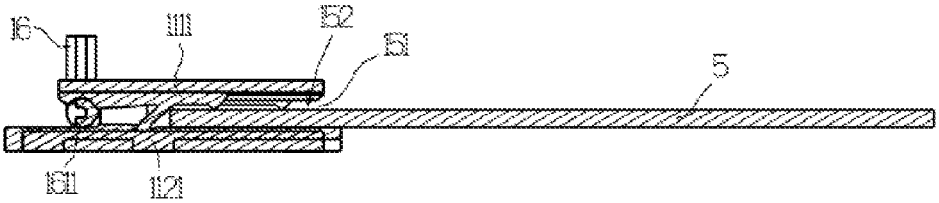
FIG. 22 is a view cut along line FF of FIG. 21.

In addition, as shown in FIGS. 21 and 22, the actuation body 16 may also be forced to rotate to release the pushing of those pushing terminals 1611 for those first, second upper clamp arms 1111, 1121 in order to release electrical contact of those first, second upper clamp arms 1111, 1121 and the flexible printed circuit board 5. In the invention, the pushing portion 16111 of the pushing terminal 1611 may be made as a solid structure (as shown in FIG. 17) or a hollow structure (as shown in FIG. 18) for adapting to the actuation insulation seat 162 joined therewith. The material of the pushing terminal 1611 is selected from metal or ceramic. The pushing terminal 1611 and the actuation insulation seat selected from plastic material may compose the actuation body of composite material to reduce effectively fracture or abrasion opportunity of the actuation body due to the material of the pushing terminal is selected from metal or ceramic.

The second example of the invention is a drawer based FPC connector. Refer to FIGS. 23 to 28 together. As shown in the figures, the reinforcement terminal set 12 and/or the connector insulation seat 13 are formed with a slide rail structure for the upper cover 14 with actuation capability to be capable of assemblage with the connector insulation seat 13 integrally to form the drawer based FPC connector shown in FIG. 24.

Figure 25:
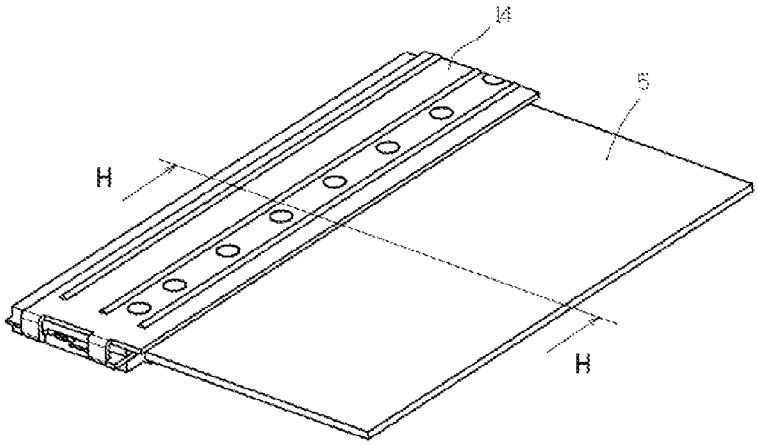
FIG. 25 is a schematic view showing a first usage state of the second example for the multiple-piece FPC connector of the invention, wherein the multiple-piece FPC connector shown in FIG. 25 is in a usage state of electrical connection with a flexible printed circuit board.
Figure 26:
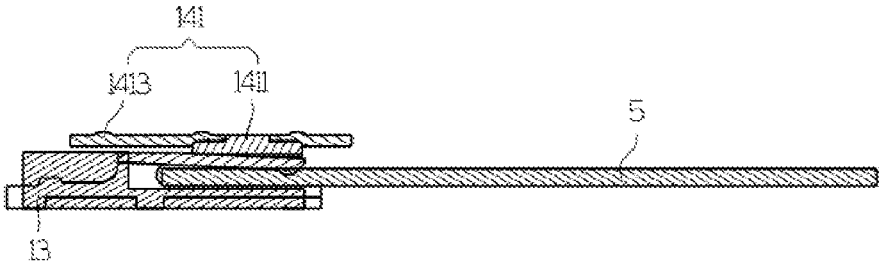
FIG. 26 is a view cut along line HH of FIG. 25.

In the example, the upper cover 14 may slide relative to the connector insulation seat 13 by means of the above slide rail structure. The flexible printed circuit board may enter the framework structure constituted by the upper cover 14 and the connector insulation seat 13 to get close to the electric conduction terminal set. After that, the upper cover 14 may slide toward to the insertion opening of the framework structure and actuate the electric conduction terminal set 11, such that electrical contact of the flexible printed circuit board and the electric conduction terminal set is achieved, as shown in FIGS. 25 and 26. However, not limited thereto, electrical contact of the flexible printed circuit board and the electric conduction terminal set may be achieved by the upper cover to slide away from the insertion opening of the framework structure.

Figure 27:
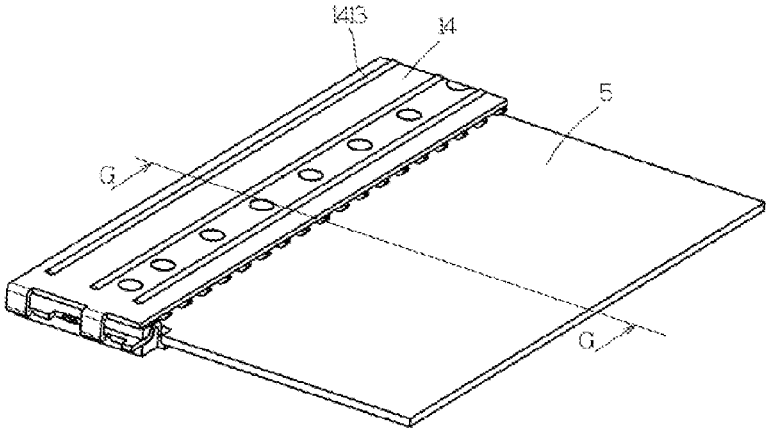
FIG. 27 is a schematic view showing a second usage state of the second example for the multiple-piece FPC connector of the invention, wherein the multiple-piece FPC connector shown in FIG. 27 is not in a usage state of electrical connection with a flexible printed circuit board.
Figure 28:
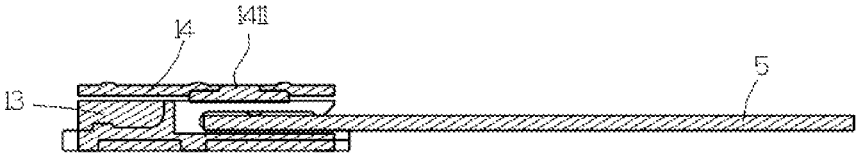
FIG. 28 is a view cut along line GG of FIG. 27.

In addition, the upper cover 14 may slide away from the insertion opening of the framework structure to stop actuation of the electric conduction terminal set 11 for releasing electrical contact of the flexible printed circuit board and the electric conduction terminal set, as shown in FIGS. 27 and 28. However, not limited thereto, electrical contact of the flexible printed circuit board and the electric conduction terminal set may be released by sliding the upper cover toward the insertion opening of the framework structure.

Figure 30:
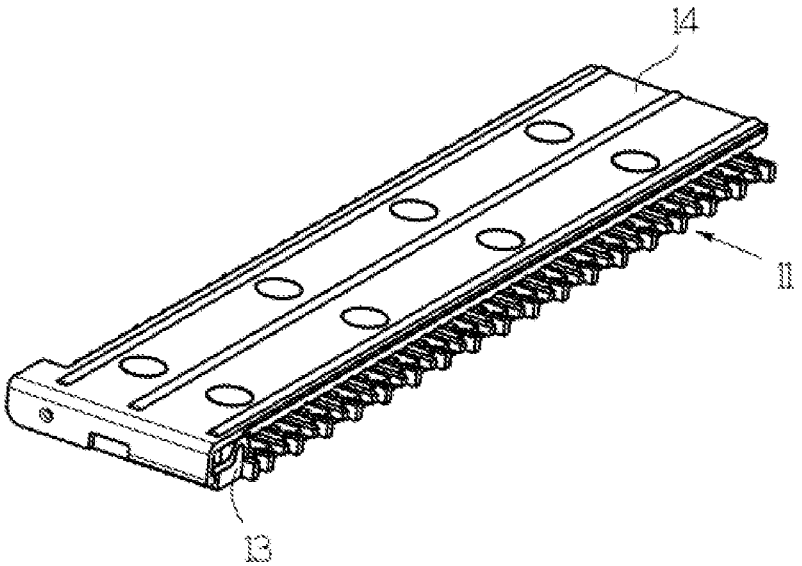
FIG. 30 is an assemblage diagram showing members in the third example for the multiple-piece FPC connector of the invention.

The third example of the invention is a forward overturning based FPC connector. Refer to FIGS. 29 to 34. The reinforcement terminal set 12 and/or the connector insulation seat 13 are formed with a hinged structure, such that the upper cover 14 having actuation capability may be assembled with the connector insulation seat 13 integrally and constitute a framework structure to form a forward overturning based FPC connector as shown in FIG. 30. In addition, the front end of the above framework structure has an insertion space. When the upper cover 14 is forced to be lifted, the insertion space may be exposed, such that the flexible printed circuit board 5 may enter the insertion space and get close to the electric conduction terminal set 11. Correspondingly, the connector insulation seat 13 is designed further with an insertion guiding structure for guiding the flexible printed circuit board to enter the insertion space inside.

Figure 31:
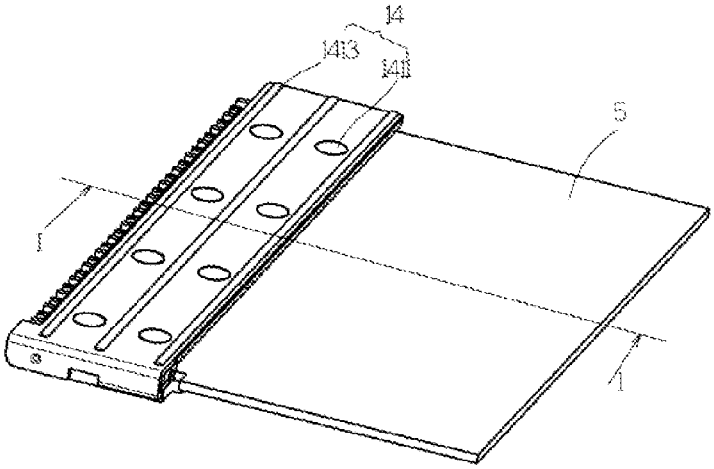
FIG. 31 is a schematic view showing a first usage state of the third example for the multiple-piece FPC connector of the invention, wherein the multiple-piece FPC connector shown in FIG. 31 is in a usage state of electrical connection with a flexible printed circuit board.
Figure 32:
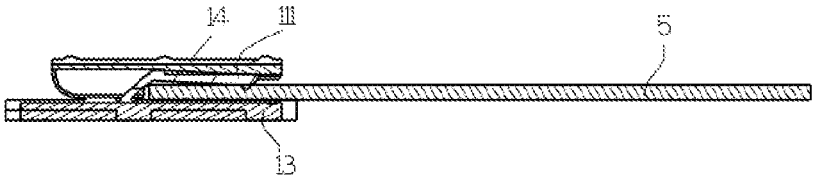
FIG. 32 is a view cut along line II of FIG. 31.
Figure 33:
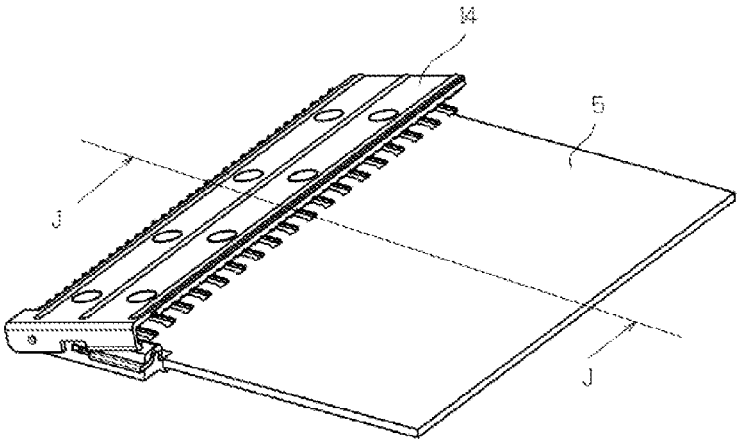
FIG. 33 is a schematic view showing a second usage state of the third example for the multiple-piece FPC connector of the invention, wherein the multiple-piece FPC connector shown in the figure is not in a usage state of electrical connection with a flexible printed circuit board.
Figure 34:
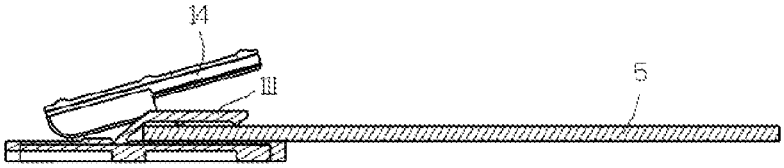
FIG. 34 is a view cut along line JJ of FIG. 33.
Figure 35:
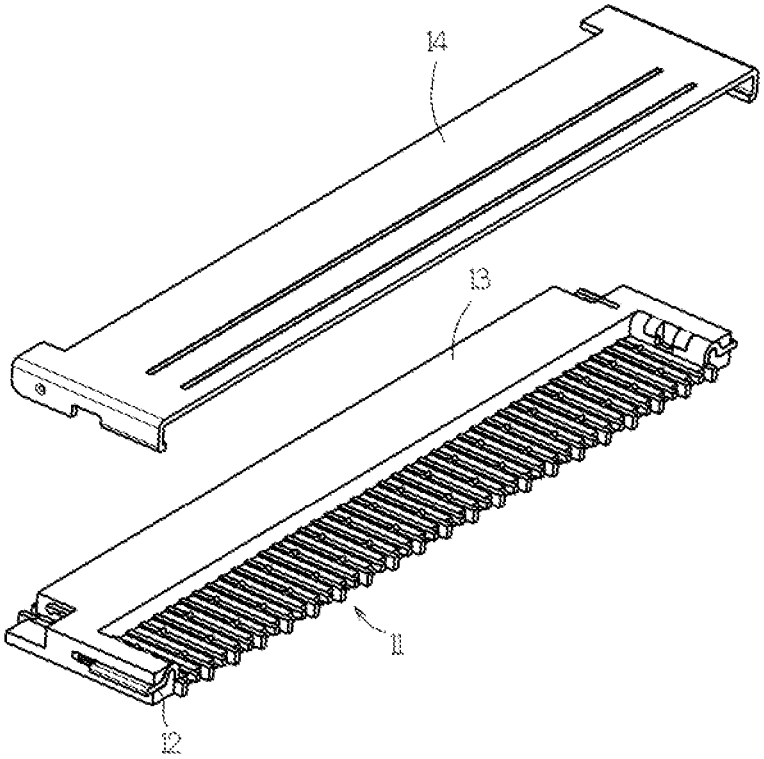
FIG. 35 is an exploded view showing members in a fourth example for the multiple-piece FPC connector of the invention.

In the example, the flexible printed circuit board may enter the insertion space of the framework structure to get close to the electric conduction terminal set. After that, the upper cover 14 may rotate toward the connector insulation seat by the hinged structure, such that the electric conduction terminal set is oppressed to deform, and electrical contact of the flexible printed circuit board and the electric conduction terminal set is achieved, as shown in FIGS. 31 and 32. Particularly, the upper cover 14 may rotate in the direction away from the connector insulation seat by the hinged structure for the electric conduction terminal set to recover the original shape elastically, and thus for the electrical contact of the flexible printed circuit board and the electric conduction terminal set to be released, as shown in FIGS. 33 and 34.

Figure 36:
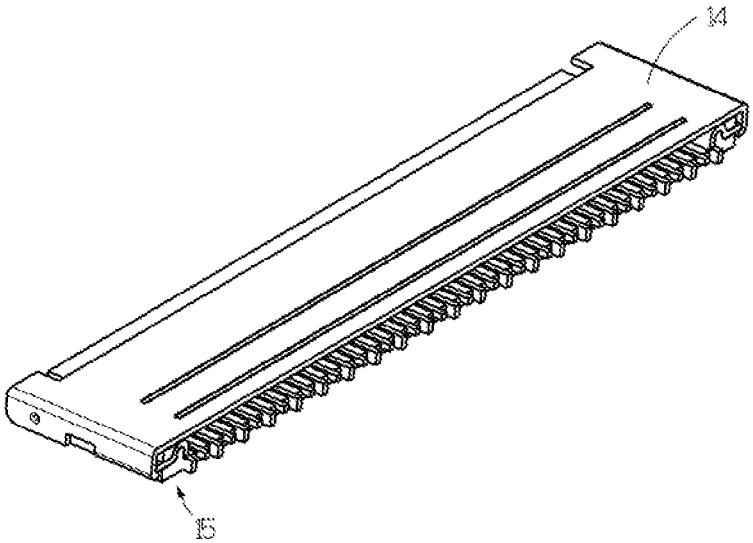
FIG. 36 is an assemblage diagram showing members in the fourth example for the multiple-piece FPC connector of the invention.

The fourth example of the invention is also a forward overturning based FPC connector. Refer to FIGS. 35 to 40. The reinforcement terminal set 12 and/or the connector insulation seat 13 are formed with a hinged structure, such that the upper cover 14 having actuation capability may be assembled with the connector insulation seat 13 integrally and constitute a framework structure 15 to form a forward overturning based FPC connector as shown in FIG. 36. It should be noted that the upper cover of the example may be forced to be lifted for the insertion space to be exposed, such that the flexible printed circuit board may enter the insertion space to get close to the electric conduction terminal set. The upper cover may also be forced for actuation, such that electrical contact of the flexible printed circuit board and the electric conduction terminal set are achieved.

Figure 39:
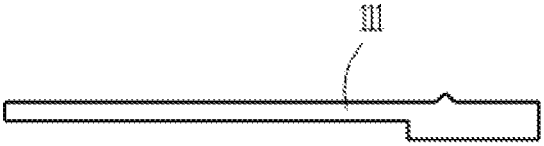
FIG. 39 is an enlarged view showing a single first electric conduction terminal of the fourth example for the multiple-piece FPC connector of the invention.
Figure 40:
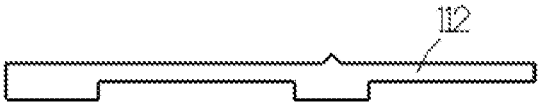
FIG. 40 is an enlarged view showing a single second electric conduction terminal of the fourth example for the multiple-piece FPC connector of the invention.

The example and the third example differ mainly in that each of the electric conduction terminals in the example does not have structure design of upper clamp arm and linkage (as shown in FIG. 39, FIG. 40), but each of the electric conduction terminals still keeps at least one electrical joint corresponding to the flexible printed circuit board, so that the height dimension and manufacturing difficulty of the multiple-piece FPC connector may be reduced significantly, and the thinnest and smallest multiple-piece FPC connector is thus resulted.

It should be noted that in order to assure consistent joint pressure of each of the electric conduction terminals for the flexible printed circuit board, each of the electric conduction terminals in the example may be forced to deform elastically in the same direction to compensate height difference of electrical joints between there.

Figure 37:
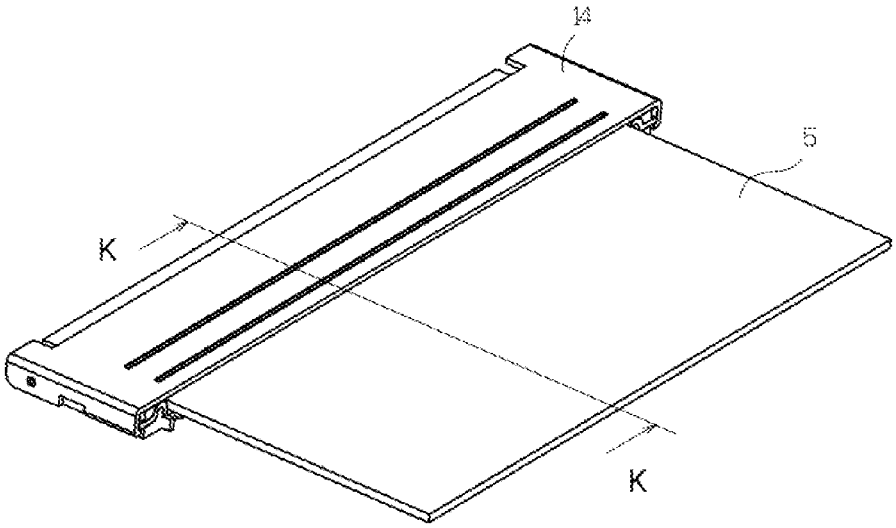
FIG. 37 is a schematic view showing a usage state of the fourth example for the multiple-piece FPC connector of the invention, wherein the multiple-piece FPC connector shown in the figure is in a usage state of electrical connection with a flexible printed circuit board.
Figure 38:
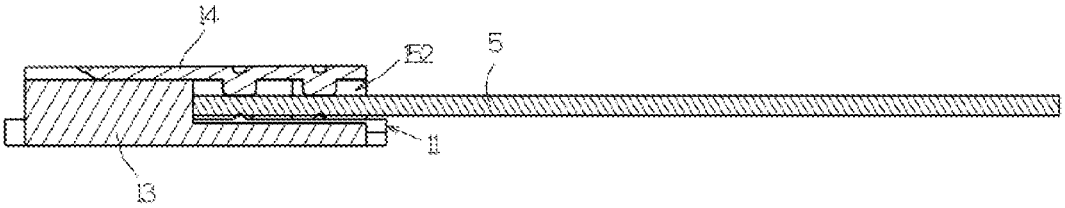
FIG. 38 is a view cut along line KK of FIG. 37.

As shown in FIGS. 37 and 38, the upper cover 14 may be made of plastic material or composite material composing of metal and plastic, and may rotate toward the connector insulation seat 13 by the aforementioned hinged structure until a press structure below the connector insulation seat 13 oppresses the flexible printed circuit board, such that the flexible printed circuit board may move toward to the electric conduction terminal set 11 until electrical contact with the electric conduction terminal set is achieved.

In summary, the invention disposes an insulation seat and a cover separately to constitute a multiple-piece FPC connector, the electric conduction terminal set of the invention is buried into an insert molding mold of a connector insulation seat in advance in order to join the connector insulation seat and the electric conduction terminal set integrally during insert molding for the connector insulation seat, such that fixation for the electric conduction terminal set is achieved without plug equipment. Thereby, complexity of making the FPC connector is reduced, and the issues of electric conduction terminal dropping and residual stress of insulation seat are solved.

In addition, the multiple-piece FPC connector of the invention may be designed as forward overturning based, rearward overturning based and drawer based FPC connector. Compared to conventional rearward overturning based FPC connector, the rearward overturning based FPC connector of the invention has an actuation body made of a composite material composing of, for example, metal and plastic, such that abrasion and fracture of using the actuation body may be reduced due to material characteristics of metal.

The examples above are only illustrative to explain principles and effects of the invention, but not to limit the invention. It will be apparent to those skilled in the art that modifications and variations can be made without departing from the scope of the invention. Therefore, the protection range of the rights of the invention should be as defined by the appended claims.

What is claimed is:

1. A multiple-piece FPC connector for electrically connecting a flexible printed circuit board, including:

an electric conduction terminal set (11), which has multiple first electric conduction terminals (111) and second electric conduction terminals (112) in an interlacing arrangement for crimping electrical joints of the flexible printed circuit board, respectively, the first and second electric conduction terminals (111, 112) having a predetermined electric conduction terminal pitch, the first electric conduction terminals (111) being constituted by a first upper crimping arm (1111), a first lower crimping arm (1112) and a first linkage (1113), respectively, the first linkage (1113) being connected with the first upper crimping arm (1111) and the first lower crimping arm (1112), the second electric conduction terminals (112) being constituted by a second upper crimping arm (1121), a second lower crimping arm (1122) and a second linkage (1123), respectively, the second linkage (1123) being connected with the second upper crimping arm (1121) and the second lower crimping arm (1122);

a reinforcement terminal set (12), which has at least two reinforcement terminals (121) provided on left and right sides;

a connector insulation seat (13), which is made by insert molding, burying the entirety or part of the first and second lower crimping arms (1112, 1122) into an insert molding mold of the connector insulation seat (13) prior to the insert molding for the connector insulation seat (13), such that the connector insulation seat (13) is joined with the first and second lower crimping arms (1112, 1122) integrally to fix the electric conduction terminal set (11) by the connector insulation seat (13); and an upper cover (14), which can join with the connector insulation seat (13) to constitute a framework structure (15), and the framework structure (15) has an insertion opening (151) and an insertion space (152) in a front end, and the flexible printed circuit board can enter the insertion space (152) to get close to the electric conduction terminal set (11) via the insertion opening (151);

wherein, the first and second electric conduction terminals (111, 112) of the electric conduction terminal set (11) can be forced for actuation to be in electrical contact with the flexible printed circuit board, respectively;

wherein, the connector insulation seat (13) and the upper cover (14) are separately to constitute a multiple-piece structure;

wherein the upper cover (14) can be slid or rotated relative to the connector insulation seat (13) to constitute a drawer based FPC connector or a forward overturning based FPC connector, and further includes a cover insulating piece (141) disposed on the bottom of the upper cover (14), and the cover insulating piece (141) has an insulation pushing portion (1411) to force the first and second upper crimping arms (1111, 1121) to be in electrical contact with electrical joints of the flexible printed circuit board entering the insertion space (152) by means of rotation using a rotation portion of the first and second linkages (1113, 1123) connected thereto as a fulcrum, respectively.

2. The multiple-piece FPC connector according to claim 1, wherein further includes a first electric conduction terminal material belt (1114), which has a first electric conduction terminal connection portion (11141), and a second electric conduction terminal material belt (1124), which has a second electric conduction terminal connection portion (11241), and the first electric conduction terminal connection portion (11141) is intersected with the body of the first electric conduction terminals (111) perpendicularly, and the second electric conduction terminal connection portion (11241) is intersected with the body of the second electric conduction terminals (112) perpendicularly.

3. The multiple-piece FPC connector according to claim 1, wherein the upper cover (14) and the connector insulation seat (13) are assembled integrally to constitute a rearward overturning based FPC connector, and further includes an actuation body (16) provided on a rear end of the framework structure (15) in a rotatable manner, the actuation body (16) having a pushing terminal set (161) and an actuation insulation seat (162), the pushing terminal set (161) having multiple pushing terminals (1611), which are arranged in one row and all having a pushing portion (16111), a pitch of the pushing terminals (1611) being essentially the same as that of the first and second electric conduction terminals (111, 112), the actuation insulation seat (162) being joined with the pushing terminals (1611), and the actuation body (16) can be forced to rotate relatively to the framework structure (15) for the pushing portions (16111) of the pushing terminals (1611) to push the first and second upper crimping arms (1111, 1121) corresponding to the locations thereof, respectively, to force the first and second upper crimping arms (1111, 1121) to be in electrical contact with electrical joints of the flexible printed circuit board entering the insertion space (152) by means of rotation using a rotation portion of the first and second linkages (1113, 1123) connected thereto as a fulcrum, respectively.

4. The multiple-piece FPC connector according to claim 1, wherein the cover insulating piece (141) further has multiple insulation baffles (1411), which are extended to a position between the first and second electric conduction terminals (111, 112) downward, respectively.

* * * * *